US006278238B1

(12) United States Patent
Hong

(10) Patent No.: US 6,278,238 B1
(45) Date of Patent: Aug. 21, 2001

(54) PLASMA DISPLAY PANEL WITH SPACERS DIAGONALLY OPPOSED TO THE ELECTRODE SETS

(75) Inventor: Jin-Won Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/079,167

(22) Filed: May 15, 1998

(30) Foreign Application Priority Data

May 16, 1997 (KR) ..... 1997-19064

(51) Int. Cl.[7] ..... H01J 17/16; H01J 17/49

(52) U.S. Cl. ..... 313/584; 313/582; 313/586

(58) Field of Search ..... 313/567, 581, 313/582, 584, 586, 609, 610, 634, 317, 292

(56) References Cited

U.S. PATENT DOCUMENTS 3,873,870 * 3/1975 Fukushima et al. ..... 313/217
4,185,229 * 1/1980 Yoshikawa et al. ..... 315/169.4
5,107,182 * 4/1992 Sano et al. ..... 315/169.4
5,825,128 * 10/1998 Betsui et al. ..... 313/582

* cited by examiner

*Primary Examiner*—Ashok Patel
*Assistant Examiner*—Matthew John Gerike
(74) *Attorney, Agent, or Firm*—Finnegan, Henderson, Farabow, Garrett & Dunner, L.L.P.

(57) ABSTRACT

A plasma display panel is provided to solve the problem of crosstalk due to discharge which generates from plasma diffusion between cells adjacent to each other, preventing color spread of the vertical edge. The plasma display panel of the invention includes a barrier located at an angle to its data electrode, the barrier being formed on an upper substrate on which a sustain electrode is formed.

4 Claims, 7 Drawing Sheets

PLASMA DISPLAY PANEL WITH SPACERS DIAGONALLY OPPOSED TO THE ELECTRODE SETS

BACKGROUND OF THE INVENTION

A. Field of the Invention

The present invention relates to a plasma display panel (PDP), more particularly to a three-electrode PDP.

B. Description of the Prior Art

The unit cell of a conventional three-electrode surface discharging PDP is constructed, as shown in FIG. 1, in such a manner that a scan electrode 2 to which a scan pulse is applied during address period and a sustain electrode 3 to which a sustain pulse for maintaining discharge are formed on an upper substrate 10, a data electrode 1 to which a data pulse for generating sustain discharge between scan electrode 2 and sustain electrode 3 is formed on a lower substrate 20, a dielectric layer 6 is coated under upper substrate 10 for protecting scan electrode 2 and sustain electrode 3, and an R, G, B phosphor 5 is formed on data electrode 1 and placed between barriers 4 supporting upper and lower substrates 10 and 20. A cell (not shown) is formed at a portion where a vertical electrode (that is, scan electrode 2 and sustain electrode 3) intersects a horizontal electrode (that is, data electrode 1) and these cells construct a PDP.

A general operation of the three-electrode surface discharging PDP is explained below. First of all, a reset pulse is supplied to scan electrode 2, and then a write enable pulse is applied thereto. Here, when a write pulse is applied to data electrode 1 of a cell to be displayed, discharging occurs in a selected scan line, and wall charge is formed. Thereafter, when the sustain pulse is applied to sustain electrode 3, the discharging is maintained and the scan electrode make a couple with the sustain electrode, sustaining the discharge.

In the aforementioned conventional PDP, and as shown in FIG. 2, barriers 4 and data electrode 1 are formed in parallel with each other, allowing plasma to be freely diffused between cells which are vertically adjacent to each other. However, this may bring about crosstalk, undesirable discharge, between the cells. Furthermore, the barrier of the conventional PDP is formed on the lower substrate. Thus, if there is a gap between the barrier and upper substrate, plasma is diffused to other cells through the gap, and it can easily generate undesirable discharge even at low voltage, deteriorating the picture quality.

SUMMARY OF THE INVENTION

Accordingly, the present invention is directed to a plasma display panel that substantially obviates one or more of the problems due to limitations and disadvantages of the related art.

An object of the present invention is to provide a PDP which does not allow plasma to be diffused to other cells.

Another object of the present invention is to prevent discharge at lower voltage.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises: a first substrate; a second substrate opposite the first substrate; a barrier separating the first and second substrates; a scan electrode adjacent the first substrate and providing a scan pulse; a data electrode adjacent the second substrate and providing a data pulse, wherein the barrier overlying the data electrode has a non-zero angle therebetween.

It is to be understood that both the foregoing general description and the following detailed description are exemplary and explanatory only and are not restrictive of the invention, as claimed.

BRIEF DESCRIPTION OF THE ATTACHED DRAWINGS

The accompanying drawings, which are incorporated in and constitute a pait of this specification, illustrate embodiments of the invention and together with the description, serve to explain the principles of the invention.

DETAILED DESCRIPTION OF PREFERRED EMBODIMENT

Figure 1:
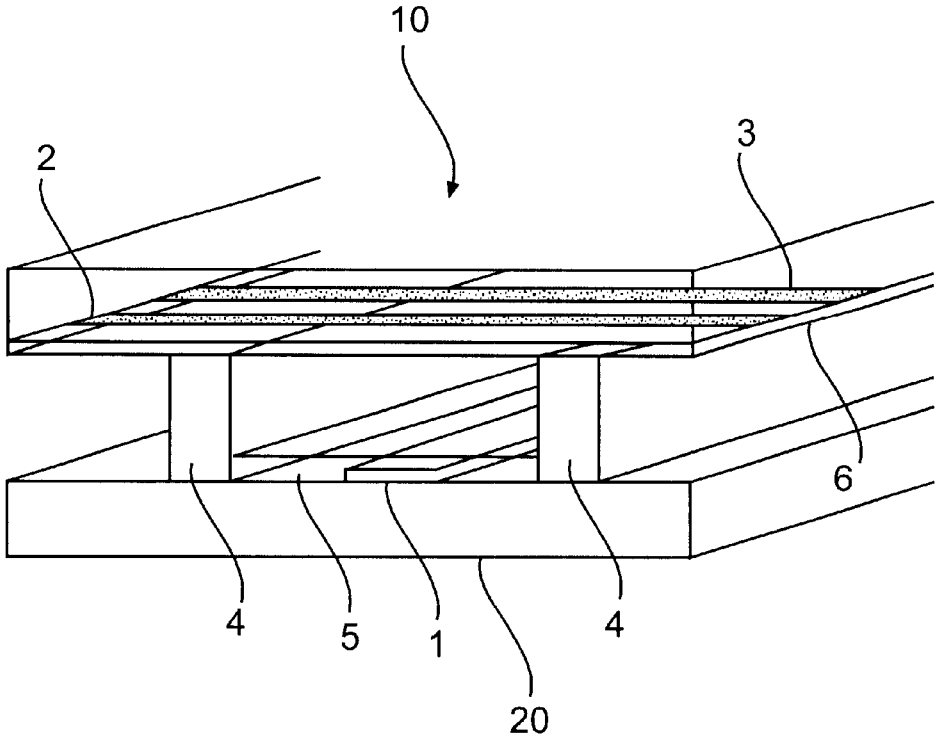
FIG. 1 PRIOR ART
FIG. 1 is a perspective view of the unit cell of a conventional PDP.
Figure 2:
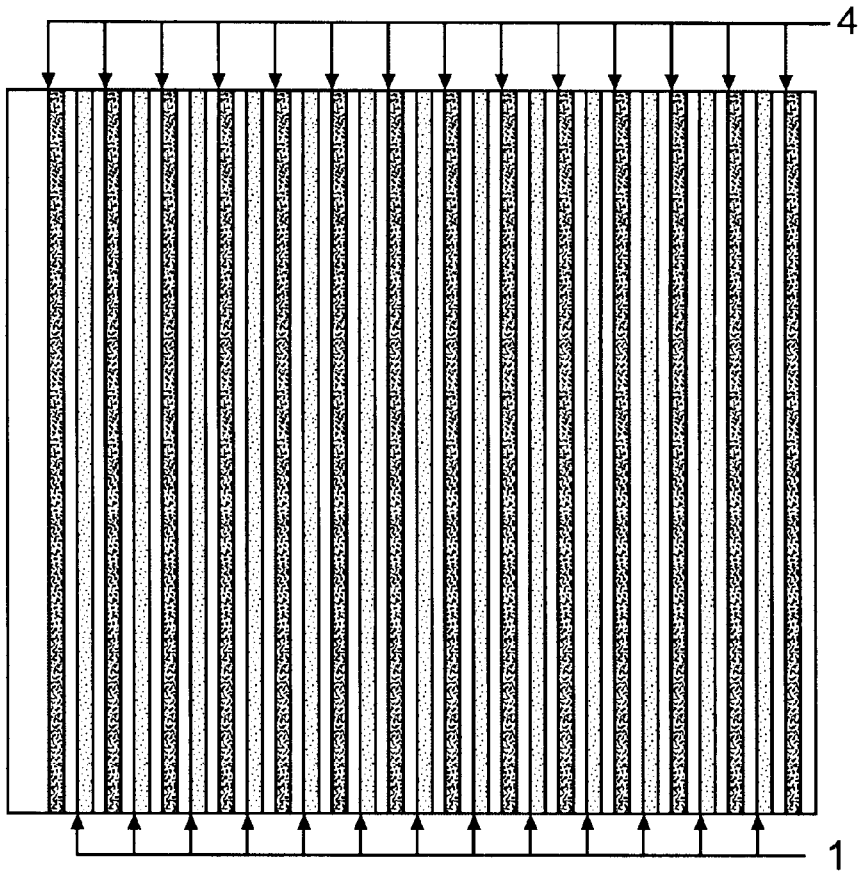
FIG. 2 PRIOR ART
FIG. 2 is a view showing the lower substrate of the conventional PDP.

Reference will now be made in detail to the preferred embodiments of the present invention, examples of which are illustrated in the accompanying drawings. Wherever possible, the same reference numbers will be used throughout the drawings to refer to the same or like parts.

A PDP consistent with the present invention provides a data electrode and barrier that are not arranged in parallel with each other but they are located at an angle to each other. The PDP also may have the barrier formed on an upper substrate to prevent discharging due to plasma diffusion between cells.

A PDP of the present invention is explained below with reference to FIGS. 3 to 7. Referring to FIG. 4, the PDP of the present invention is constructed in such a manner that a sustain electrode 103, scan electrode 104 and data electrode 105 are arranged between upper and lower substrates 101 and 102, sustain electrode 103 and scan electrode 104 being located in parallel with each other, data electrode 105 is located in perpendicular to sustain electrode 103 and scan electrode 104, and a cell 106 is formed at a portion where sustain electrode 103 and scan electrode 104 intersect data electrode 105, in which barrier 100 is arranged on upper substrate 101 and located at a specific angle to data electrode 105. In FIG. 4, reference numeral 107 denotes a dielectric layer, and 108 denotes a phosphor.

Figure 3:
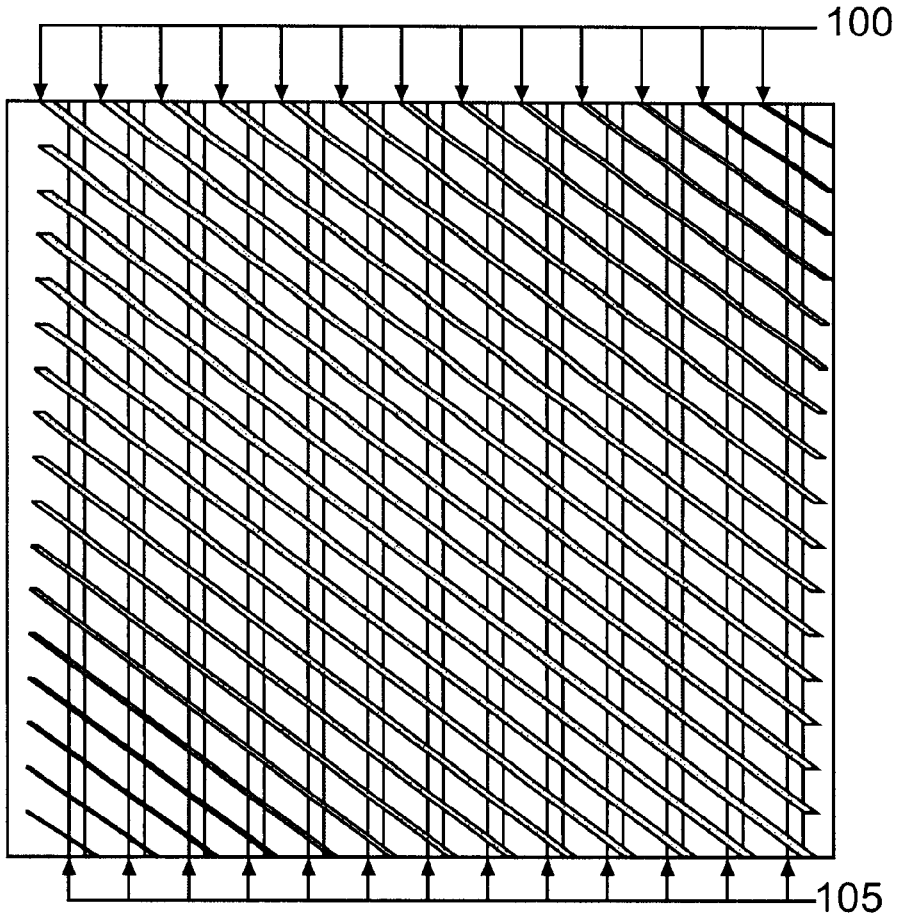
FIG. 3 is a view showing the lower substrate of a PDP according to the present invention.
Figure 4:
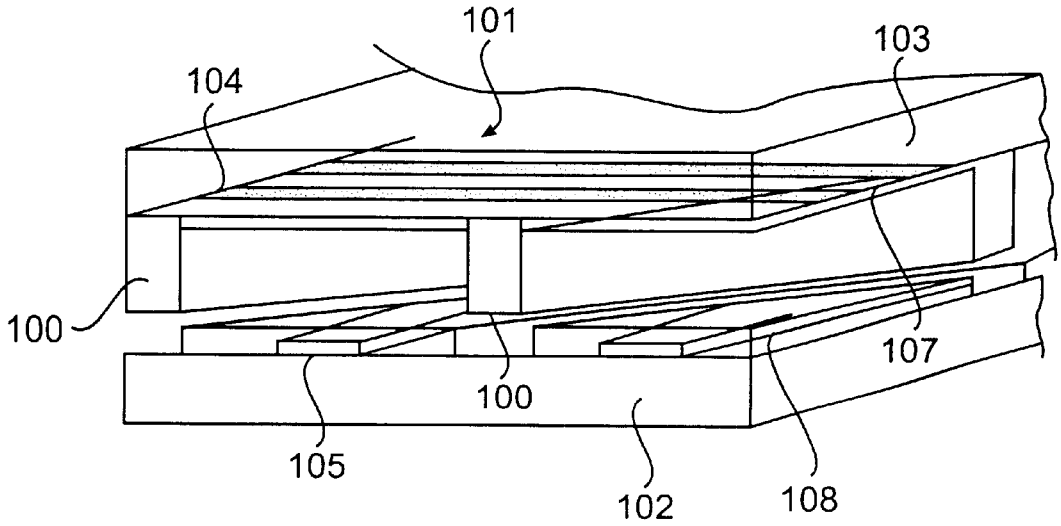
FIG. 4 is a perspective view of the unit cell of the PDP according to the present invention.
Figure 5:
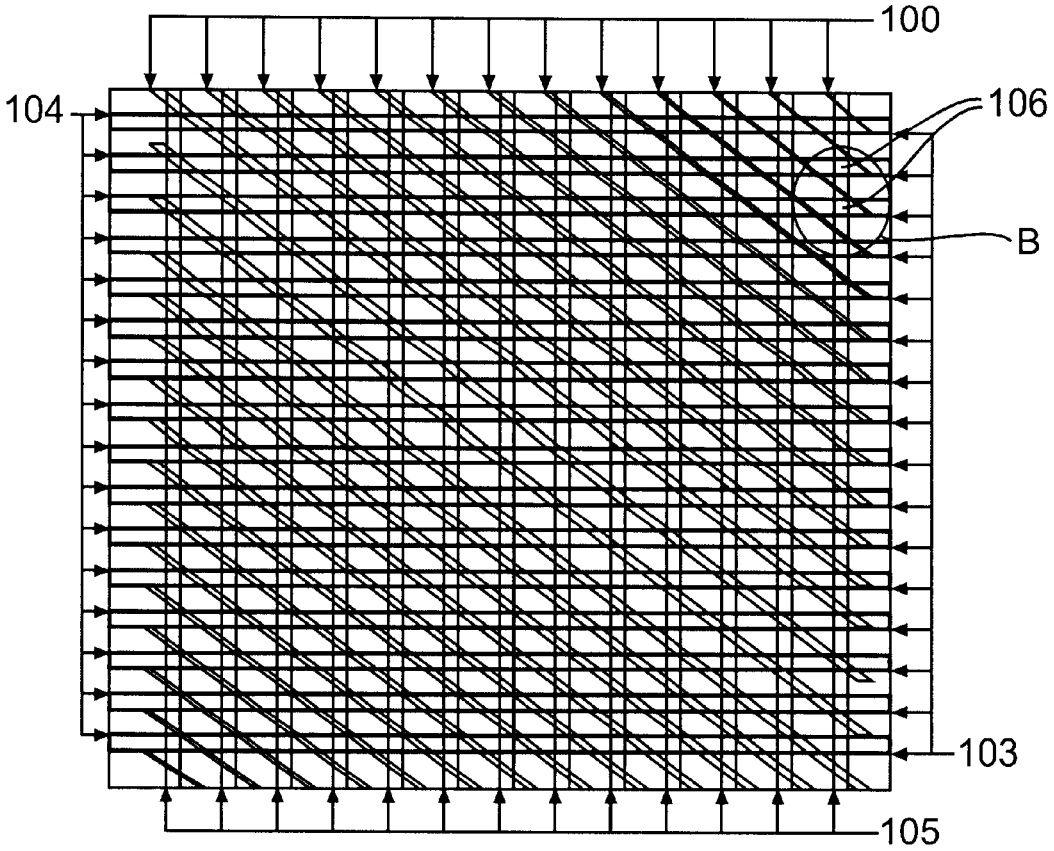
FIG. 5 is a view showing the structure of the PDP according to the present invention.

FIGS. 3 and 5 are views showing the structure of the PDP according to the present invention. As shown in the figures, barriers 100 and data electrode are arranged at an angle, rather than running parallel to each other.

Figure 6:
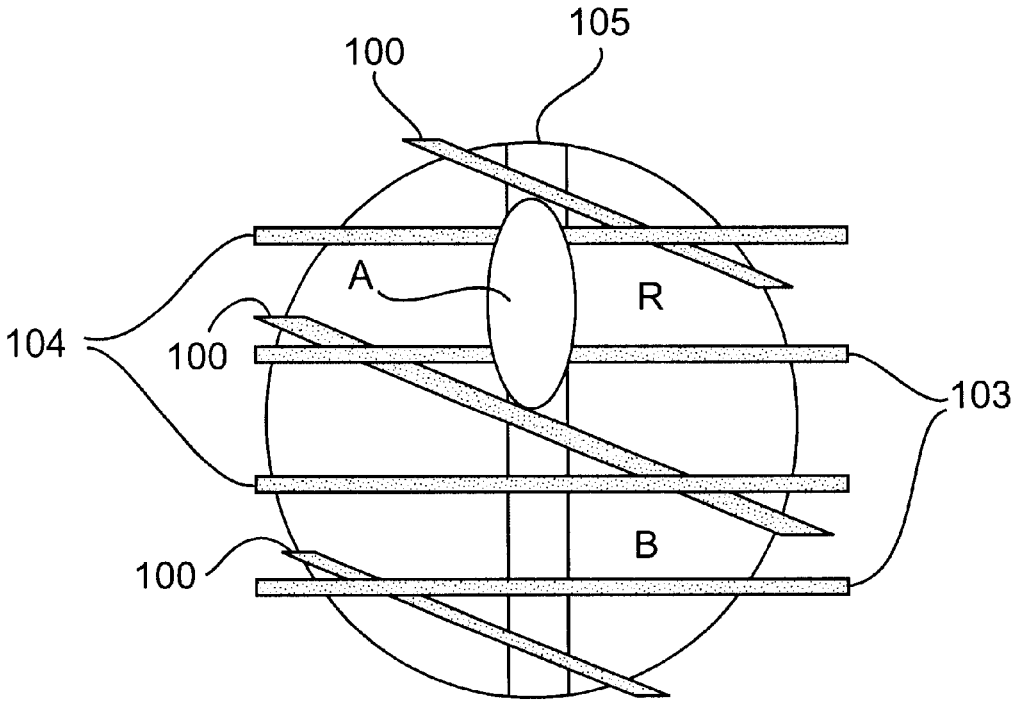
FIG. 6 is a view showing portion B of FIG. 5 in detail.

Referring to FIG. 6, in the PDP constructed as above, an R region cell (corresponding to R of R, G, B) is shown and a B region cell (corresponding to B of R, G, B) is shown immediately below the R region cell, and barrier 100 is placed between these two cells. Accordingly, plasma due to discharge, which occurs in the R region, is not diffused to the B region, preventing crosstalk. Sustain discharge occurs in uppear substrate 101 between scan electrode 104 and data electrode 105, as shown in "A" in FIG. 6. Furthermore, there is prefereably no gap between upper substrate 101 and barrier 100 because barrier 100 is formed on upper substrate 101. Moreover, plasma formed near upper substrate 101 is not diffused to other cells.

Figure 7:
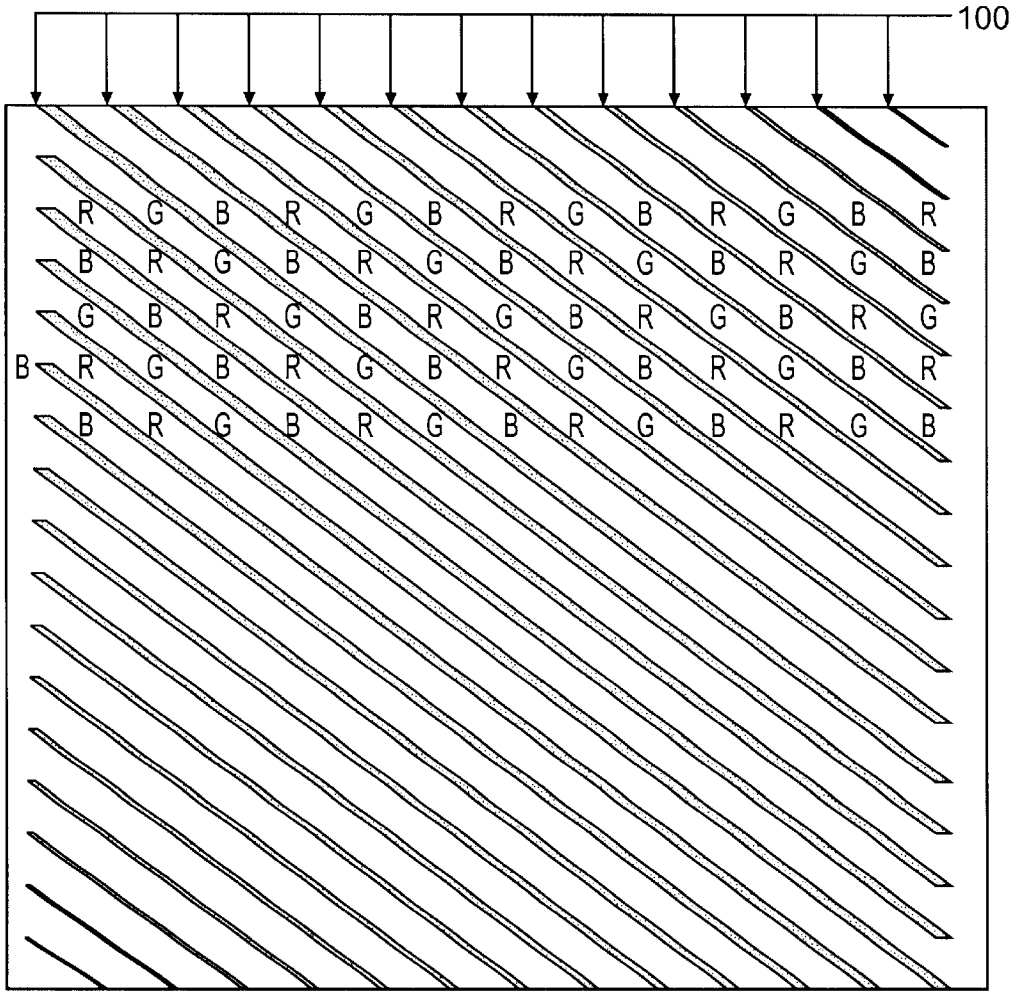
FIG. 7 is a view showing regions according to colors (R, G, B) of phosphors.

FIG. 7 shows regions according to colors (R, G, B) of phosphor 108. Referring to FIG. 7, when a picture is displayed, vertical and horizontal edges are gentle since the arrangements (strips) of phosphors (R, G, B) 108 are mixed vertically and horizontally. The picture quality is improved because there is no color spread. Even though phosphors 108 are mixed horizontally and vertically, the fabrication of the PDP can be easily performed because it is carried out through a simple process similar to the conventional one. As described above, the PDP of the present invention does not allow plasma to be diffused to other cells during its operation, preventing crosstalk.

It will be apparent to those skilled in the art that various modifications and variations can be made in the plasma display panel of the present invention without departing from the spirit or scope of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A plasma display panel, comprising:

a first substrate;

a second substrate opposite said first substrate;

a barrier separating said first and second substrates, wherein said barrier is formed on the first substrate;

a scan electrode adjacent said first substrate and providing a scan pulse;

a data electrode adjacent said second substrate and providing a data pulse, said barrier overlying said data electrode having a non-zero angle therebetween.

2. The plasma display panel as claimed in claim 1, further comprising a sustain electrode adjacent said first substrate and providing a sustain pulse, said sustain electrode being substantially parallel to said scan electrode.

3. The plasma display panel as claimed in claim 1, further comprising a phosphor strip between said first and second substrates and substantially parallel with said barrier.

4. The plasma display panel as claimed in claim 1, further comprising a plurality of phosphor strips each corresponding to a different color between said first and second substrates, each phosphor strip being substantially parallel with said data electrode.

* * * * *